US006573901B1

(12) United States Patent
Rai

(10) Patent No.: US 6,573,901 B1
(45) Date of Patent: Jun. 3, 2003

(54) VIDEO DISPLAY CONTROLLER WITH IMPROVED HALF-FRAME BUFFER

(75) Inventor: Barinder Singh Rai, Surrey (CA)

(73) Assignee: Seiko Epson Corporation, Tokyo (JP)

( * ) Notice: Subject to any disclaimer, the term of this patent is extended or adjusted under 35 U.S.C. 154(b) by 204 days.

(21) Appl. No.: 09/670,058

(22) Filed: Sep. 25, 2000

(51) Int. Cl.[7] ..... G09G 5/36
(52) U.S. Cl. ..... 345/547; 345/98; 365/189.12
(58) Field of Search ..... 345/536, 537, 345/538, 539, 540, 541, 545, 546, 547, 98; 365/189.01, 189.12, 220, 221, 240; 711/109

(56) References Cited

U.S. PATENT DOCUMENTS 4,369,504 A * 1/1983 Hanmura ..... 365/219
5,142,276 A 8/1992 Moffat
5,163,024 A * 11/1992 Heillveil et al. ..... 365/219
5,274,589 A * 12/1993 Koshizuka ..... 365/189.01
5,373,310 A * 12/1994 Ichimura et al. ..... 345/98
5,394,170 A * 2/1995 Akeley et al. ..... 345/556
5,430,464 A 7/1995 Lumelsky
5,452,235 A 9/1995 Isani
5,537,128 A 7/1996 Keene et al.
5,587,726 A 12/1996 Moffat
5,677,704 A 10/1997 Kusano et al.
5,689,731 A 11/1997 West et al.
5,696,534 A 12/1997 Lavelle et al.
5,742,788 A * 4/1998 Priem et al. ..... 395/437
5,854,620 A 12/1998 Mills et al.
5,945,974 A 8/1999 Sharma et al.
6,246,388 B1 * 6/2001 Motegi et al. ..... 345/98
6,418,078 B2 * 7/2002 Hashimoto et al. ..... 365/233

* cited by examiner

*Primary Examiner*—Steven Saras
*Assistant Examiner*—Fritz Alphonse
(74) *Attorney, Agent, or Firm*—Mark P. Watson

(57) ABSTRACT

A video display controller incorporates an improved half-frame buffer that can be implemented and operated at lower cost. In one implementation, the half-frame buffer incorporates a distribution circuit that receives three serial digital signals conveying bits representing red, green and blue (RGB) colors in an image. The distribution circuit multiplexes the RGB bits into a signal parallel register so that a complete set of RGB information can be written to or retrieved from memory during a single clock cycle. Preferably, the distribution circuit is implemented by simple signal-switching logic.

24 Claims, 6 Drawing Sheets

VIDEO DISPLAY CONTROLLER WITH IMPROVED HALF-FRAME BUFFER

TECHNICAL FIELD

The present invention pertains generally to interface circuitry for video display devices and pertains more specifically to an improved half-frame buffer for use in a video display device controller.

BACKGROUND ART

Digital display devices such as liquid crystal display (LCD) panels, thin-film-transistor (TFT) panels and plasma panels are used in various applications such as personal computer systems, a variety of hand-held devices such as a so called Personal Digital Assistant (PDA), and microprocessor based industrial controllers to present visual images. Digital display devices are being incorporated into additional types of applications as manufacturing costs of the display devices continue to decrease.

Some display devices use multiple display components or panels such as LCD panels to present a single image. An implementation using multiple LCD panels, for example, is attractive because it allows a display device to be made with smaller, lower cost LCD panels. In principle, any number of display components may be used; however, a typical implementation uses two. In a typical two-panel implementation, one display panel is used to present the upper half of the image and the other display panel is used to present the lower half of the image.

Electronic circuitry sometimes referred to as a video adapter or a display controller provides an interface between a digital display device and various other components that provide the digital information representing an image to be presented. In typical applications, a display controller receives digital information that represents the image to be presented and, in response, generates frames of output digital signals arranged that convey a representation of the image comprising individual picture elements or "pixels" arranged in rows. Each "frame" of the output signals causes an attached digital display device to present a complete rasterized image. The output digital signals are generated by the display controller to meet the input signal requirements of the display device.

When a display device incorporates two display panels to present a single image, the display controller can use what is know as a half-frame buffer to improve the quality of the presentation by reducing image flicker. This is accomplished by concurrently providing half-frame output signals for each display panel. The display controller uses the half-frame buffer to store a previously generated half-frame output signal for one display panel while the half-frame output signal is being generated for the other display panel. A typical method for using a half-frame buffer is described in the following paragraph.

As the display controller receives image information to be presented by the first display panel, it passes this image information immediately to the display device. Concurrently, the display controller also fetches from the half-frame buffer image information to be presented by the second display panel and passes this information to the display device. The display controller then stores the image information for the first display panel in the half-frame buffer. Subsequently, the display controller receives image information to be presented by the second display panel and passes this image information immediately to the display device. Concurrently, the display controller fetches from the half-frame buffer the image information to be presented again by the first display panel. The display controller then stores the image information for the second display panel in the half-frame buffer.

A display controller usually has a bus or set of parallel circuit paths for handling digital image signals in a parallel form. The width of these buses or parallel paths has been increased to satisfy the demand for high-performance presentation of images with higher spatial resolution and finer gradations of color or shading. Widths of 32 bits are commonly used and greater widths of 64 bits or more will become more common as higher levels of display performance are required.

Typically, a half-frame buffer comprises serial and parallel storage registers that are implemented by flip-flops. Unfortunately, the number of flip-flops required to implement these registers is proportional to width of the parallel circuit paths mentioned above and has grown as this width has been increased. The growing number of flip-flops required to implement these registers is undesirable because more circuit board space is required for the hardware components that implement the registers. This prevents or restricts the degree to which a display controller can be made smaller as other advances in circuit miniaturization are realized. In addition, more power is required to operate the increasing number of flip-flops, which increases heat generation and reduces battery life in portable applications.

DISCLOSURE OF INVENTION

It is an object of the present invention to provide for a half-frame buffer in a display controller that has lower implementation and operation costs.

According to one aspect of the present invention, a display controller that provides output signals representing pixels in a color image for presentation on a display device comprises a first storage register to receive first parallel signals conveying bits representing all of the colors in a plurality of colors; a second storage register coupled to the first storage register to receive second parallel signals representing a first set of bits representing all of the colors in the plurality of colors; an information-storage memory; a memory-access controller coupled to the information-storage memory to retrieve second information from a location in the information-storage memory that represents a second set of bits representing all of the colors in the plurality of colors and to provide fourth parallel signals conveying the second information, and coupled to the second storage register to receive third parallel signals conveying first information that represents the first set of bits and to write the first information to the location in the information-storage memory; and an output-interface circuit coupled to the memory-access controller to receive signals conveying the second information and, in response, to generate output signals representing the second information as a portion of the image for presentation by the display device.

According to another aspect of the present invention, a buffer in a display controller that provides output signals representing pixels in a color image for presentation on a liquid crystal display panel comprises an LCD interface circuit having inputs coupled to video memory; a distribution circuit having inputs coupled to outputs of the LCD interface circuit; a first storage register having parallel inputs coupled to outputs of the distribution circuit; a second storage register having parallel inputs coupled to parallel outputs of the first storage register; information-storage memory; and a memory-access controller having parallel input/output ports coupled to the information-storage memory, having parallel inputs coupled to parallel outputs of the second storage register, and having outputs coupled to inputs of the LCD interface circuit.

According to yet another aspect of the present invention, a method for receiving and storing information in a buffer of a display controller that provides output signals representing pixels in a color image for presentation on a display device comprises steps that perform the acts of receiving a plurality of digital signals, each signal conveying a sequence of bits representing a respective color in a plurality of colors for each of the pixels; distributing a first set of bits conveyed by the digital signals into information-storage cells of a first storage register such that the first storage register stores information representing all of the colors in the plurality of colors; sending parallel signals representing the first set of bits as stored in the first storage register to information-storage cells in a second storage register; retrieving second information from a location in information-storage memory that represents a second set of bits representing all of the colors in the plurality of colors and providing signals conveying the second information; writing first information to the location in the information-storage memory representing the first set of bits; and sending the signals conveying the second information to an interface circuit and, in response, generating output signals representing the second information as a portion of the image for presentation by the display device.

According to yet another aspect of the present invention, a buffer in a display controller that provides output signals representing pixels in a color image for presentation on a liquid crystal display panel comprises a switching network having a plurality of inputs to receive a plurality of digital signals, each input to receive a respective digital signal conveying a sequence of bits representing a respective color in the plurality of colors for each of the pixels; a first set of storage registers coupled to the switching network to receive first parallel signals conveying bits representing all of the colors in a plurality of colors; a second set of storage registers coupled to the first set of storage registers to receive second parallel signals conveying a first set of bits representing all of the colors in the plurality of colors; a third set of storage registers; an information-storage memory; a memory-access controller coupled to the information-storage memory to retrieve second information from a location in the information-storage memory that represents a second set of bits representing all of the colors in the plurality of colors and to provide fourth parallel signals conveying the second information to the third set of storage registers, and coupled to the second set of storage registers to receive third parallel signals conveying first information that represents the first set of bits and to write the first information to the location in the information-storage memory; and an output-interface circuit coupled to the third set of storage registers to receive fifth parallel signals conveying the second information and, in response, to generate output signals representing the second information as a portion of the image for presentation by the display device.

The various features of the present invention and its preferred implementations may be better understood by referring to the following discussion and the accompanying drawings in which like reference numerals refer to like elements in the several figures. The contents of the following discussion and the drawings are set forth as examples only and should not be understood to represent limitations upon the scope of the present invention.

MODES FOR CARRYING OUT THE INVENTION

A. Overview

1. System

Figure 1:
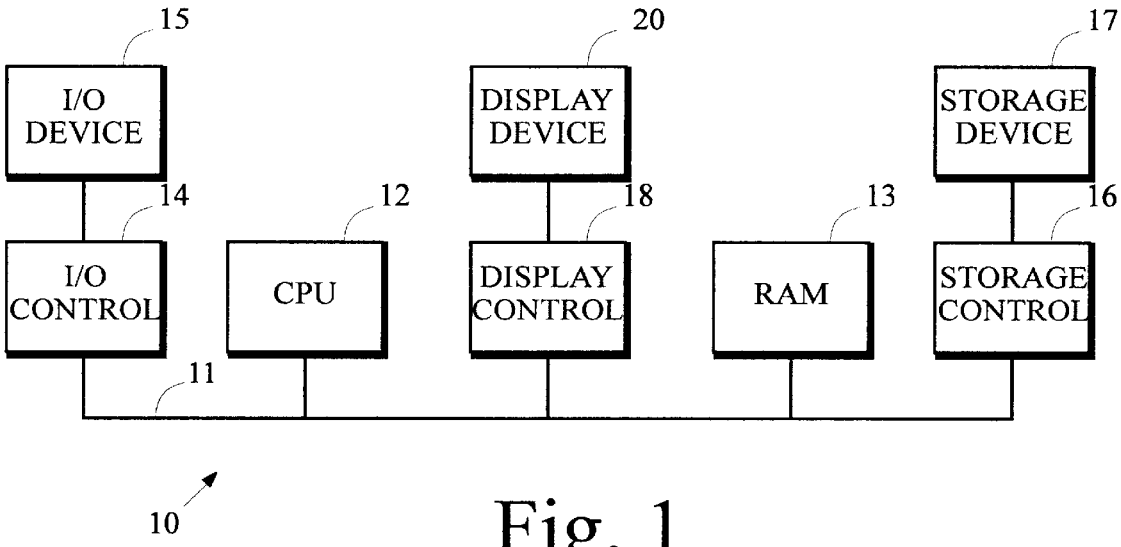
FIG. 1 is a schematic block diagram of a computer system that incorporates a video display controller.

A display controller according to the present invention may be implemented in a number of ways and incorporated into a wide variety of systems and apparatuses including a personal desktop computer system, a portable laptop computer system, a hand-held computer, or PDA. FIG. 1 is a block diagram of computer system 10 that may incorporate a display controller according to the present invention. CPU 12 provides computing resources. I/O control 14 represents an interface to input/output device 15 such as a keyboard or buttons, mouse, stylus or other pointing device, or printer. Storage control 16 represents an interface to storage device 17 that includes a storage medium such as magnetic tape or disk, an optical medium, or a solid state medium. The storage medium may be used to record programs of instructions for operating systems, utilities and applications. Display control 18, which incorporates various aspects of the present invention, provides an interface to display device 20. RAM 13 is system random access memory (RAM). This memory should not be confused with memory that exists in display control 18.

In the implementation shown, all major system components connect to bus 11, which may represent more than one physical bus. For example, some personal desktop and laptop computers incorporate only one bus that conforms to the so called Industry Standard Architecture (ISA) or some variant of ISA. Other examples of these types of computers incorporate buses that conform to one or more bus standards such as the ISA standard, the Peripheral Component Interconnect (PCI) standard, and the Advanced Graphic Port (AGP) standard. Hand-held computers and PDAs generally incorporate a bus that conforms to some proprietary specification. A bus architecture is not required to practice the present invention.

The functions of one or more of these components can be implemented in a wide variety of ways including discrete logic components, one or more ASICs and/or program-controlled processors. The type of implementation is not critical.

2. Display Device

Display device 20 may be implemented using multiple display panels such as LCD panels to present a single image represented by a raster of picture elements or "pixels" arranged in rows that are refreshed periodically row-by-row at a "refresh rate" that often equals or exceeds 60 Hz. In principle, any number of display panels may be used. A typical implementation has two panels in which one display panels is used to display the upper half of the image and the other display panels is used to display the lower half of the image.

The use of multiple display panels is also attractive because it can reduce flicker in an image by allowing different portions of the displayed image to be refreshed concurrently. In an implementation using two display panels, for example, each half of an image may be refreshed concurrently.

Figure 2:
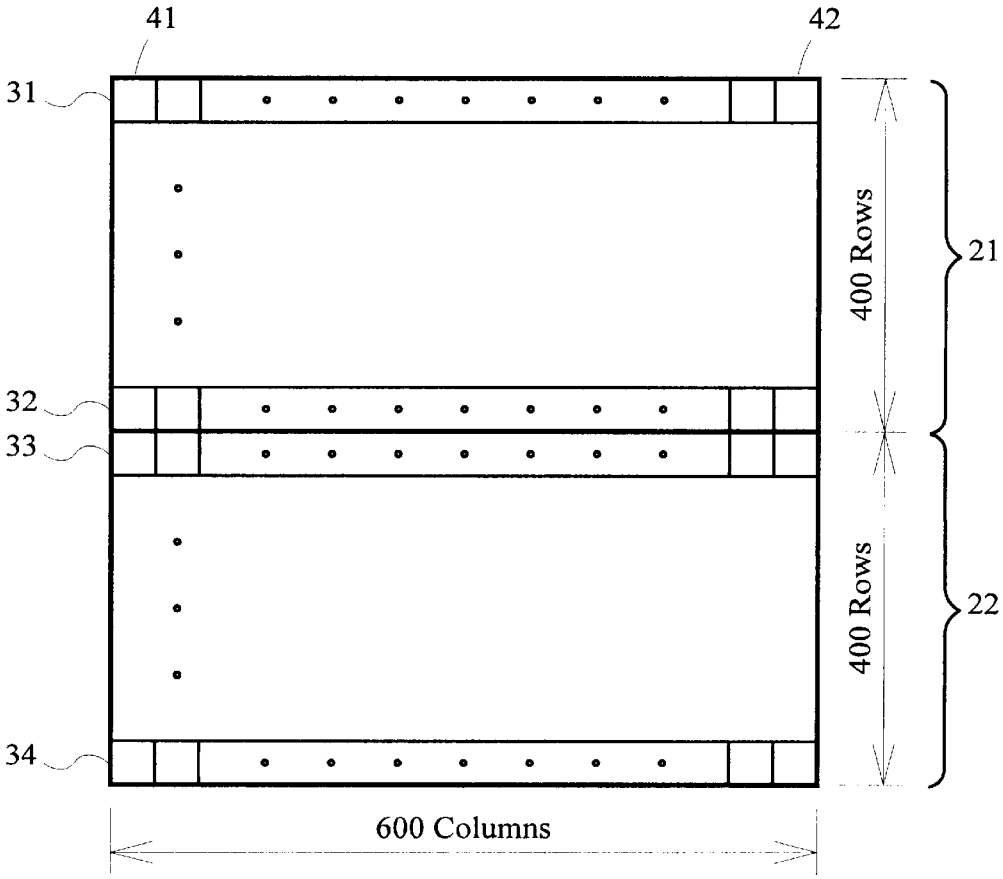
FIG. 2 is a schematic illustration of a dual-panel display for a raster image of 800 rows of 600 pixels each.

Referring to FIG. 2, one exemplary implementation of display device 20 referred to as Dual Super Twist pNeumatic (DSTN) comprises two LCD panels 21 and 22 that are used collectively to present a raster image of 800 rows each having 600 pixels. Panel 21 is used to present rows 1 through 400 (the upper half) of an image and panel 22, located adjacent to and below panel 21, is used to present rows 401 through 800 (the lower half) of the image. In this exemplary implementation, the pixels in row X of the image are refreshed concurrently with the pixels in row X+400, where the value of X ranges from 1 to 400. Various implementations and examples discussed below assume display device 20 is a DSTN device that is used to present a 800×600 pixel image; however, it should be understood the present invention may be used with a wide range of display devices that can present essentially any resolution or size of image.

3. Display Controller a) Basic Features

Figure 3:
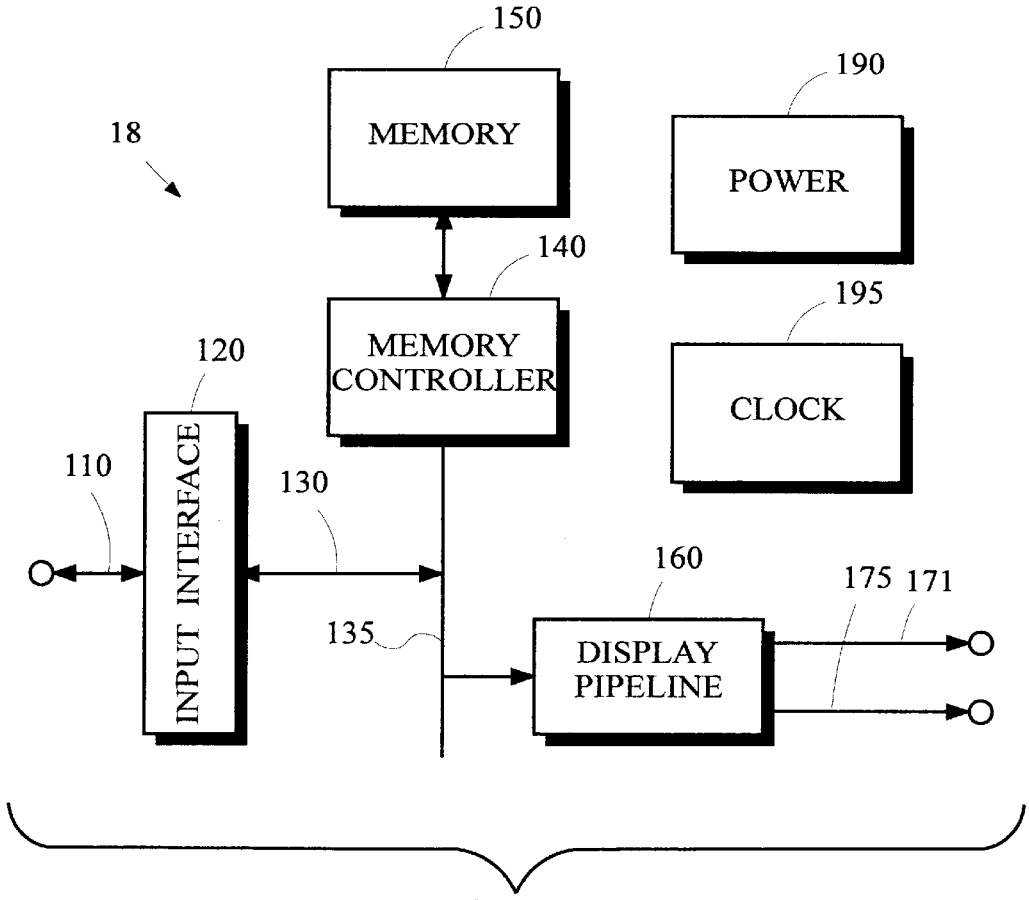
FIG. 3 is a schematic block diagram of a video display controller.

A schematic illustration of one implementation of display control 18 is provided in FIG. 3. The particular implementation illustrated in the figure includes a "display pipeline" circuit coupled to display device 20. This circuit is discussed below in more detail.

According to the implementation shown in the figure, display control 18 includes circuitry in input interface 120 that couples to signal path 110, perhaps provided by bus 1, that carries digital signals representing an image to be displayed. Input interface 120 receives from path 110 the data signals that represent image content, converts these data signals into a form that is compatible with other components in display control 18, and passes the converted data signals along path 130 to controller bus 135. Other signal paths such as those used for power, interrupts, clocks and timing references are not shown for illustrative clarity.

The data signals on controller bus 135 are received by memory controller 140 and corresponding information is written into memory 150. A wide variety of technologies including dynamic RAM, single- and dual-port video RAM, and implementations that conform to different versions of the Advanced Graphics Port (AGP) standard may be used to implement memory 150. Subsequently, memory controller 140 reads the information stored in memory 150 and passes this information to display pipeline 160. In response to the information passed to display pipeline 160, the circuitry in this display pipeline generates a sequence of data and control signals along path 175 that correspond to the content of an image and generates along path 171 a clock signal that is needed by display device 20 to present the image represented by the signals on path 175.

Power 190 represents power management circuits for display control 18. These power management circuits may be used to reduce or turn off power to one or more attached display devices to conserve energy. Although such features may be used in conjunction with the present invention, they are not essential.

Clock 195 represents circuits for providing one or more digital clock signals that are used to control the operation of other circuits in display control 18. In preferred implementations, clock signals are provided and used in a conventional manner. Details of the clock circuits are omitted from the figures for illustrative clarity.

In addition to the features discussed herein, display control 18 may incorporate other features such as cache memory, "blt block" engines, and specialized circuitry for three-dimensional rendering or texture-mapping to improve performance, and may incorporate video input/output ports that support a wider range of video applications. Although these and other features may be used in implementations that incorporate various aspects of the present invention, a discussion of these features is not needed to understand the present invention.

Figure 4:
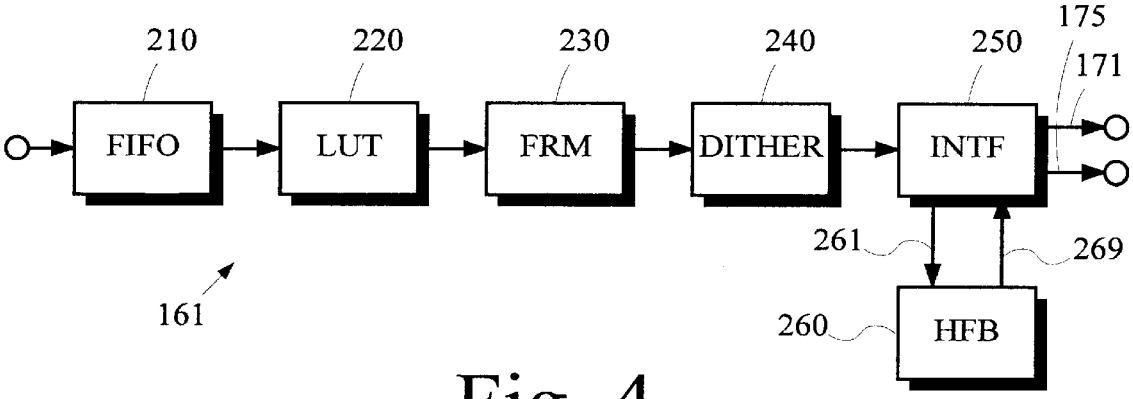
FIG. 4 is a schematic block diagram of a display pipeline circuit.

In addition, aspects of the present invention may be incorporated into implementations of display controllers that differ from the implementations discussed herein and illustrated in FIGS. 3 and 4. For example, the use of a bus architecture in general and the use of controller bus 135 in particular is not required. Furthermore, display pipeline 160 may be provided with direct access to memory 150. In this sense, the display pipeline is said to be coupled to memory 150 without limitation to whether or not there is an intervening memory controller between the memory and the display pipeline circuit.

b) Display Pipeline Circuit

The circuit of display pipeline 160 may be implemented in a wide variety of ways and may include one or more components that facilitate controlling the operation of different types of digital display devices. One combination of components for display pipeline 160 is shown schematically in FIG. 4 and is described below.

Referring to FIG. 4, display pipeline 160 includes first-in-first-out (FIFO) buffer 210, look-up table (LUT) 220, frame-rate modulator (FRM) 230, dithering circuit 240, device interface 250, and half-frame buffer (HFB) 260.

In many implementations, the flow of information from memory 150 to display pipeline 160 may be interrupted by an event that demands the immediate services of memory 150 or memory controller 140. FIFO 210 may be used in such implementations to reduce the likelihood that such interruptions will disrupt the flow of information to display device 20 coupled to the display controller.

Look-up-table functions provided by LUT 220 may be used to perform a variety of signal conversions such as, for example, mapping representations of color from one color space into another to provide color calibration for a particular display device.

Frame-rate modulation provided by FRM 230 is especially useful with certain types of passive LCD display devices to present images with a finer range of colors.

Dithering as provided by dither 240 may be used to reduce moire patterns that might otherwise appear in images presented by a digital display device.

Interface 250 provides an electrical interface to display device 20 and generates along paths 175 and 171 the appropriate data, control and clock signals needed by display device 20 to present the desired image.

HFB 260 may be used with DSTN display devices, for example. This feature is discussed below in more detail.

No particular display pipeline circuit or other combination of components like those discussed above is essential to the present invention. In principle, the functions provided by FIFO 210, LUT 220, FRM 230 and dither 240, for example, are not needed to practice the present invention. For ease of discussion, the implementations of display control 18 discussed below refer only to interface 250 and HFB 260.

c) Half-frame Buffer (1) Overview

Under the control of memory controller 140, segments of image information are read from memory 150 and passed to display interface 250. Display interface 250 passes each segment to display device 20 to immediately refresh one LCD panel and also passes the segments to HFB 260 for storage. HFB 260 fetches the stored segments at a later time and returns them to display interface 250, which in turn passes them to display device 20 to refresh the same LCD panel again during a subsequent refresh cycle. This process is described in more detail below.

As used herein, the term "segment" refers to some unit of information such as a single pixel or a set of bits that represent fractional or multiple pixels in an image. For example, a "segment" could be eight bits of digital information that in some applications or display modes corresponds to two 4-bit pixels and in other applications corresponds to only a portion of a 16-bit pixel. Typically, the size N of each segment is equal to the width of controller bus 135.

Figure 5:
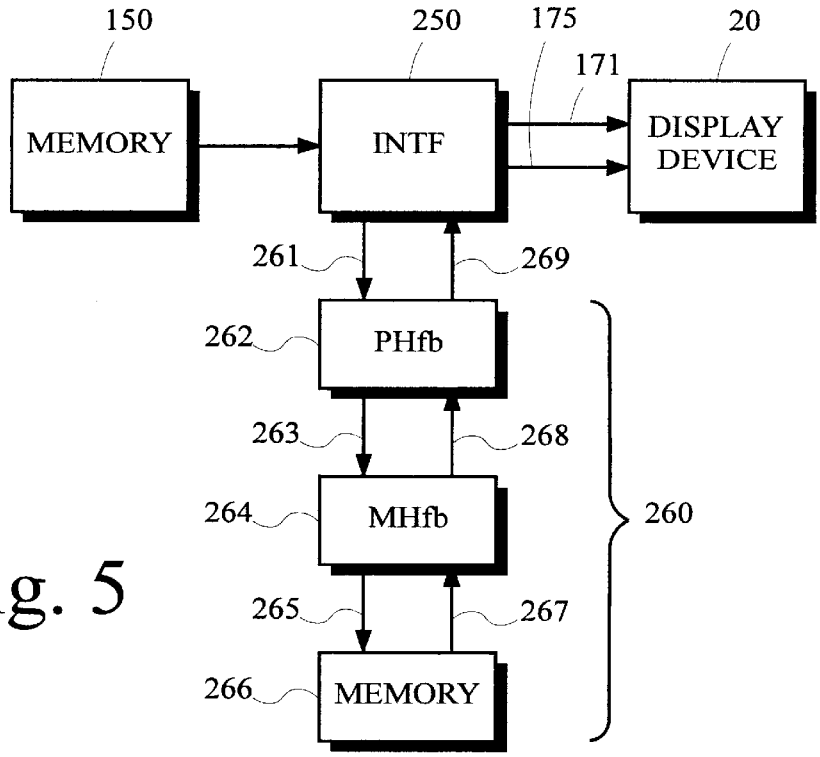
FIG. 5 is a schematic block diagram of a video display controller in which a half-frame buffer is coupled to display-device interface circuitry.
Figure 9:
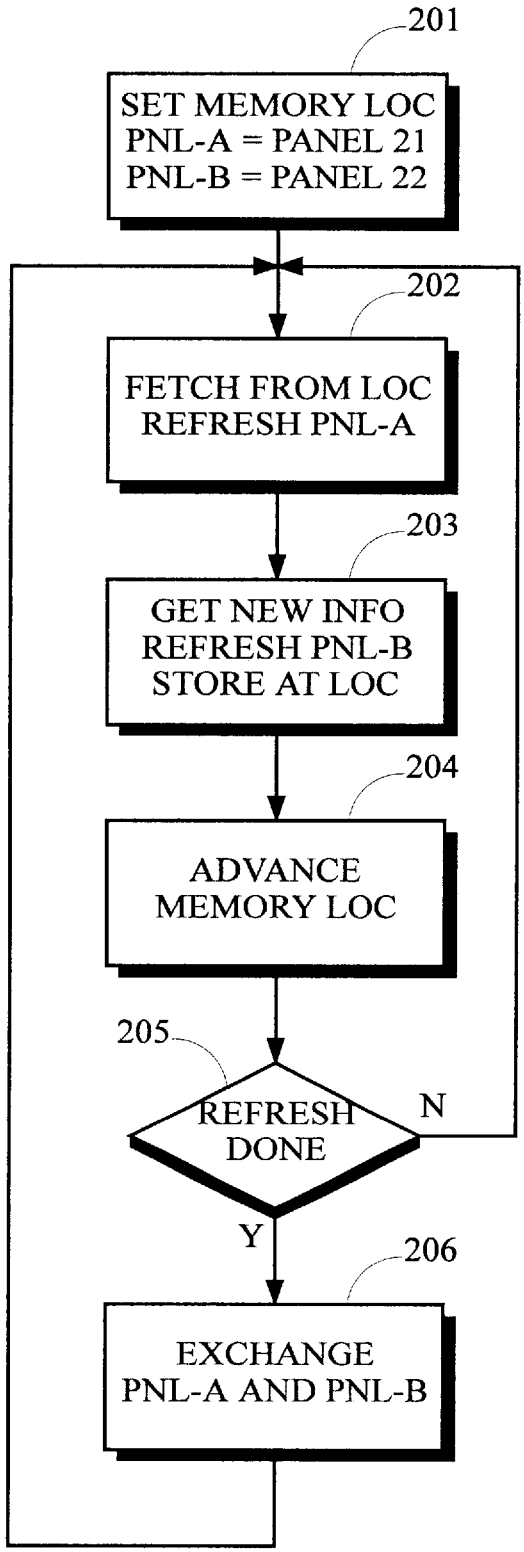
FIG. 9 is a logic flow diagram of one method that controls access to memory in a half-frame buffer used to refresh the panels in a dual-panel display device.

One implementation of HFB 260 is shown in FIG. 5. In this implementation, PHfb 262 receives segments of information in serial form from device interface 250 and converts the serial information into a parallel form. MHfb 264 receives the parallel information from PHfb 262 and stores the parallel information in memory 266. MHfb 264 also fetches parallel information from memory 266 and returns it through PHfb 262 to display interface 250. A memory-access controller in MHfb 264 controls the sequence in which information is stored to and fetched from memory 266. One method for controlling memory access is illustrated in FIG. 9 and discussed below.

(2) Serial-to-Parallel Conversion

Figure 6:
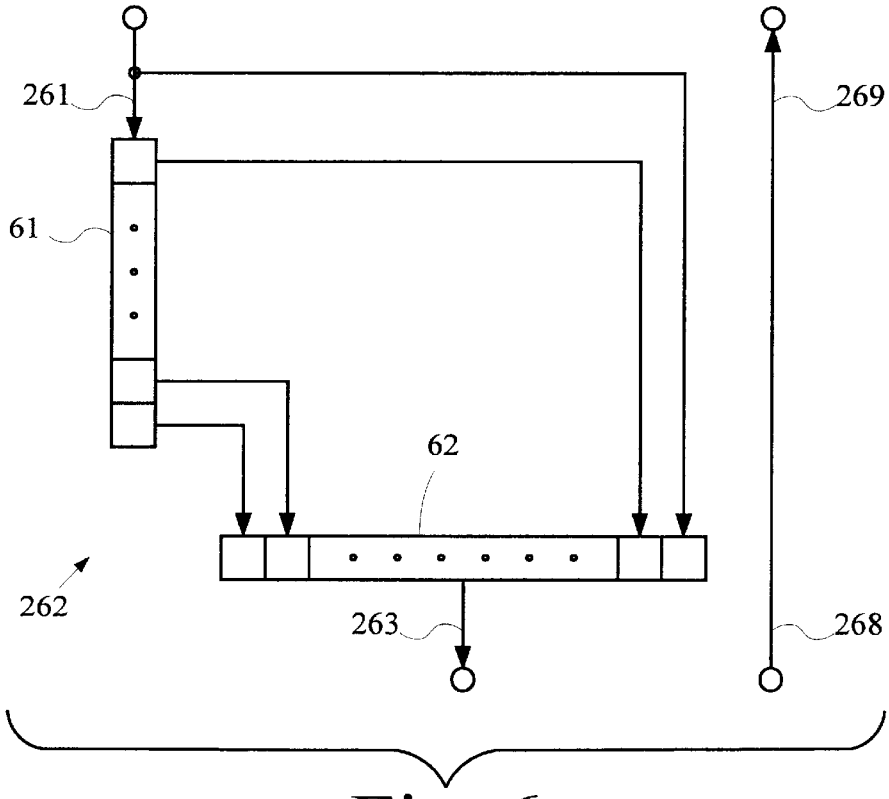
FIG. 6 is a schematic block diagram of a first portion of a half-frame buffer that incorporates a shift register and a parallel storage register.

Referring to FIG. 6, one implementation of PHfb 262 receives segments of binary information in serial form from path 261 and loads the serial information into shift register 61. Each bit of the serial information is received in synchronization with a digital clock signal, referred to herein as PClk. In this implementation, shift register 61 is capable of holding N−1 bits, for some number N that is greater than one. Preferably, N is equal to the length of a segment. In one typical example, N is equal to 64.

After N−1 bits of serial information have been loaded into shift register 61, PHfb 262 enables parallel-storage register 62 in synchronism with the next PClk cycle to receive and latch both the N−1 bits of information stored in shift register 61 and the Nth bit of information as it is received from path 261. After parallel storage register 62 has latched the N bits of information, PHfb 262 disables register 62 in synchronism with the next PClk cycle and begins loading the next N−1 bits of information into shift register 61. The information latched in parallel storage register 62 is subsequently passed to MHfb 264 along path 263.

Figure 7:
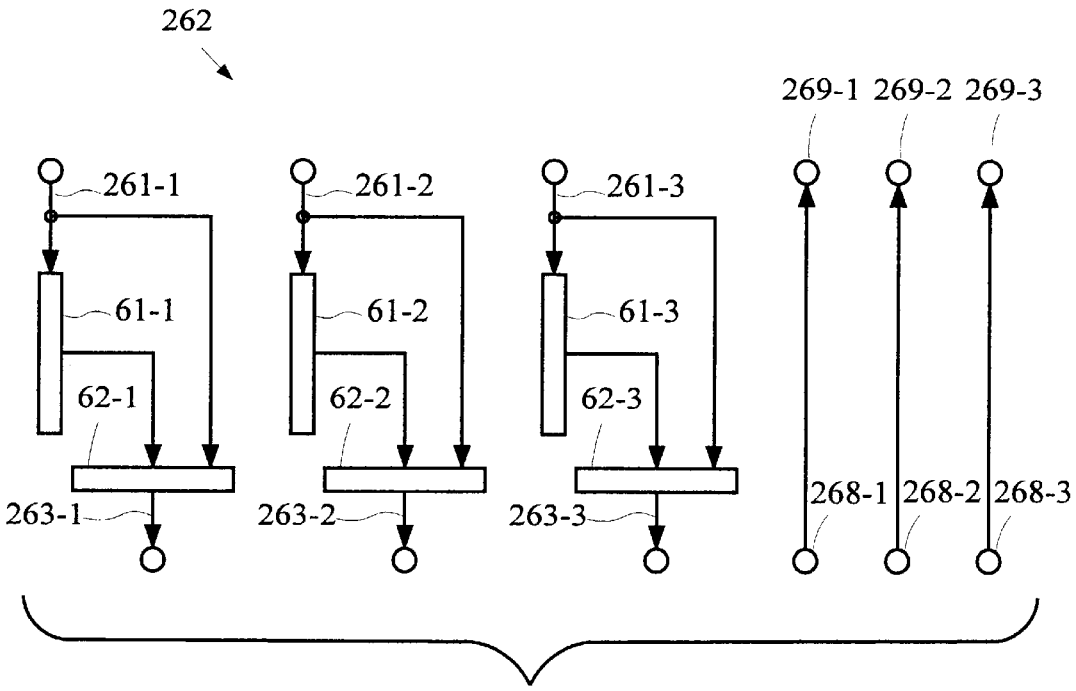
FIG. 7 is a schematic block diagram of a first portion of a half-frame buffer that incorporates multiple shift registers and multiple parallel storage registers.

FIG. 7 illustrates a similar implementation of PHfb 262 in a display controller for color images comprising red, green and blue (RGB) image components. In one typical example, path 261-1 provides serial information representing red image components, and shift register 61-1 and parallel storage register 62-1 convert this serial red-component information into a parallel form that is passed along path 263-1. Similarly, path 261-2 provides serial information representing green image components, shift register 61-2 and parallel storage register 62-2 convert this serial green-component information into a parallel form that is passed along path 263-2, path 261-3 provides serial information representing blue image components, and shift register 61-3 and parallel storage register 62-3 convert this serial blue-component information into a parallel form that is passed along path 263-3. Each of the parallel storage registers 62-1, 62-2 and 62-3 provides N bits of information for a respective color component.

(3) Memory Access Control

Figure 8:
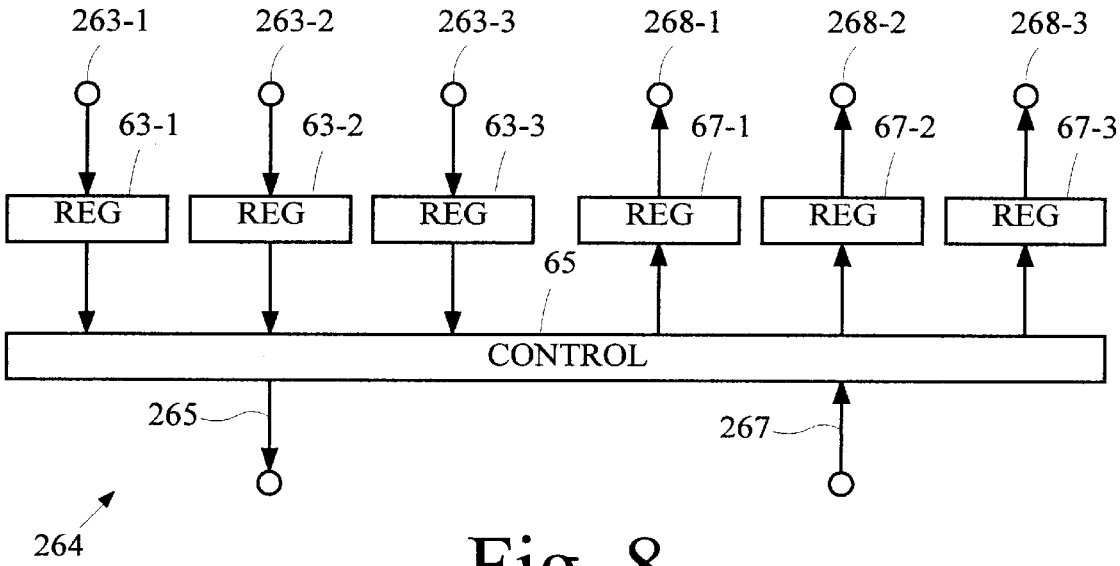
FIG. 8 is a schematic block diagram of a second portion of a half-frame buffer that incorporates multiple parallel storage registers and a memory-access controller.

One implementation of MHfb 264 for a color display device control is shown in FIG. 8. In this implementation, MHfb 264 receives and latches the N bits of information stored in each parallel storage register of PHfb 262 while PHfb 262 receives and loads serial information into a respective shift register. In this particular implementation, MHfb 264 receives RGB component information in a parallel form from paths 263-1, 263-2 and 263-3, and latches this information in parallel storage registers 63-1, 63-2 and 63-3, respectively.

The information that is received in parallel storage registers 63-1, 63-2 and 63-3 is subsequently stored in memory 266. Memory-access control 65 controls a sequence of operations that store this information in memory 266 after other information has been fetched from memory 266. Information is fetched from and stored to memory 266 in synchronization with a digital clock signal, referred to herein as MClk. The two sets of parallel storage registers 62, 63 in PHfb 262 and MHfb 264, respectively, allow PHfb 262 to receive and convert serial information while MHfb 264 waits to store the parallel information in memory 266.

In a preferred implementation, N bits of RGB color information for each color component is fetched from memory 266 during a respective-cycle of MClk and is loaded into a respective parallel storage register 67-1, 67-2 and 67-3. In other words, three fetches from memory 266 are required to obtain a complete set of RGB color information. This fetched information is subsequently passed along paths 268-1, 268-2 and 268-3 through PHfb 262 and paths 269-1, 269-2 and 269-3 to display interface 250. Display interface 250 in turn passes this fetched information to display device 20 to refresh one of the display panels.

FIG. 9 illustrates steps in one method that may be used by memory-access control 65 to control access to memory 266 for a half-frame buffer used to refresh the panels in a dual-panel display device. Step 201 initializes the process by setting an initial memory access location (MAL) and by setting two variables PNL-A and PNL-B to refer to panel 21 and panel 22 of a dual panel device, respectively. Step 202 loads into each of parallel storage registers 67-1, 67-2 and 67-3 N bits of information for a respective RGB color component fetched from memory 266 at the memory access location MAL, and sends this information to display interface 250 for refreshing a portion of the image presented by the display device panel referred to by the variable PNL-A. Initially, PNL-A refers to panel 21.

Step 203 obtains N bits of information for a respective RGB color component information from parallel storage registers 63-1, 63-2 and 63-3, respectively, and stores this information in memory 266 at the memory access location MAL. This new information is also sent immediately by display interface 250 to display device 20 to refresh a portion of the image presented by the display device panel referred to by the variable PNL-B. Initially, PNL-B refers to panel 22.

Step 204 advances the memory access location MAL to the next location for fetching and storing information. Step 205 may use this location, an image row counter or any other suitable information to determine whether the image portion presented by each panel has been completely refreshed. If not, the method reiterates beginning with step 202, which fetches N bits of information for each RGB color component from the new memory access location MAL and sends this fetched information to display interface 250 for refreshing another portion of the image presented by the display panel referred to by variable PNL-A. Step 203 obtains new RGB color component information, which is passed immediately to display device 20, and stores the new information in memory 266 at the new memory access location MAL. The memory access location MAL is advanced in step 204 and the method reiterates until the image portions presented by both panels have been completely refreshed.

When step 205 determines that the refresh has been completed, step 206 exchanges the values in variables PNL-A and PNL-B, initializes the memory access location MAL if necessary, and continues the process with step 202. At this point, information fetched by step 202 is used to refresh panel 22 and the new information obtained by step 203 is used to refresh panel 21.

The method steps shown in FIG. 9 may be revised and reordered in a number of ways. For example, the new information obtained in step 203 may be obtained prior to step 202. The new information referred to in step 203 may also be passed to display device 20 before step 202 fetches information from memory 266. An important aspect is to ensure refresh information for one panel is fetched from memory 266 before it is overwritten by new information for the other panel.

(4) Implementation Costs

In typical controllers, storage for each bit in both the shift registers and the parallel storage registers are implemented by a flip-flop. In the example discussed above for color displays, the number of flip-flops required is as follows:

TABLE I

| Register | Cost | N = 64 |
|---|---|---|
| Shift register (61) | 3 (N − 1) | 189 |
| Parallel storage register (62) | 3 N | 192 |
| Input parallel register (63) | 3 N | 192 |
| Output parallel register (67) | 3 N | 192 |
| Total flip-flop count | 12 N − 3 | 765 |

In display controllers where N is equal to the width of controller bus 135, the number of flip-flops and the cost of implementation increases as the width of controller bus 135 increases. Bus widths of 32 bits are common and greater widths of 64 bits or more will become more common as higher levels of display performance are required.

As mentioned above, the large number of flip-flops required to implement these registers is undesirable because a large amount of circuit board space is required to support the registers. This prevents or restricts the degree to which display control 18 can be made smaller as other advances in circuit miniaturization are realized. In addition, the large amount of power required to operate the large number of flip-flops is undesirable because it generates a lot of heat and reduces battery life in portable applications.

Implementation and operation costs can be reduced by merely reducing the capacity of the shift and parallel storage registers. For example, the capacity of each register could be reduced to N=20 bits; however, this solution is not sufficient in many applications. As was mentioned briefly above, the flow of information within display control 18 is sometimes interrupted by a high-priority event that demands the immediate services of a component such as memory 150 or memory controller 140. The information that flows to, through and from HFB 260 is subject to such interruptions. Because of this, the size of the shift and parallel registers within HFB 260 should be chosen to essentially eliminate the possibility that interface 250 will not receive information from HFB 260 in time to refresh a portion of the image presented by display device 20.

In the implementation described above, three fetches from memory 266 are required to obtain a complete set of RGB information. If processing is interrupted during any one of these three fetches, the information that has already been fetched from memory must be held until operation resumes and the rest of the information can be fetched. The amount of RGB information that is retrieved by the three fetches should be large enough to satisfy the demands of interface 250 during any interruption. It has been determined empirically that the capacity of each register should be at least N=64 bits.

B. Improved Half-frame Buffer

A half-frame buffer according to various aspects of the present invention may be implemented with a structure as shown in FIG. 5 to provide the same services as those explained above. In this implementation, just as in the implementation discussed above, PHfb 262 receives segments of information in serial form from device interface 250 and converts the serial information into a parallel form. MHfb 264 receives the parallel information from PHfb 262 and stores this information in memory 266. MHfb 264 also fetches parallel information from memory 266 and returns it through PHfb 262 to display interface 250. A memory-access controller in MHfb 264 controls the sequence in which information is stored to and fetched from memory 266. The same basic method illustrated in FIG. 9 and discussed above may be used to control memory access.

1. Serial-to-Parallel Conversion

Figure 10:
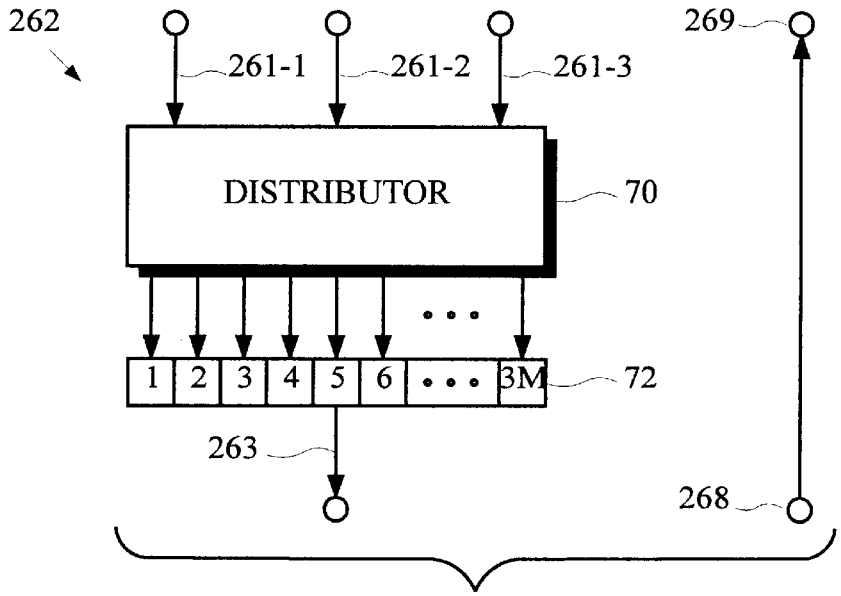
FIG. 10 is a schematic block diagram of a first portion of a half-frame buffer that incorporates a distributor for distributing signals into a single parallel storage registers.

An implementation of PHfb 262 is shown in FIG. 10. In this implementation, distributor 70 receives from paths 261-1, 261-2 and 261-3 serial binary information for red, green and blue components of a color image, respectively. The serial information is received in synchronization with a PClk digital clock signal. Distributor 70 distributes this RGB color information to information-storage cells in parallel storage register 72. In a preferred implementation, distributor 70 receives one bit of red information, one bit of green information, and one bit of blue information with each PClk cycle and distributes the three bits in parallel to respective cells in register 72.

When filled, parallel storage register 72 stores M bits of red information, M bits of green information and M bits of blue information. In a preferred implementation, as shown in FIG. 10, parallel storage register 72 stores the RGB color information in a form that is interleaved bit-by-bit. Specifically, information-storage cell 1 in register 72 stores one bit of red information, cell 2 stores one bit of green information, cell 3 stores one bit of blue information, cell 4 stores one bit of red information, and so on up to cell 3M that stores one bit of blue information.

No particular interleave pattern is critical to practice the present invention. In an alternative implementation, for example, a set of M adjacent cells in register 72 store red information, a second set of M adjacent cells in register 72 store green information, and a third set of M adjacent cells in register 72 store blue information. The discussion below assumes the RGB color information stored in register 72 is interleaved bit-by-bit.

Distributor 70 may be implemented in a variety of ways. Although not preferred, distributor 70 may be implemented with three shift registers, each register having a length equal to M and being coupled to the appropriate cells of register 72. In one preferred implementation shown in FIG. 11, distributor 70 comprises counter 271 and logic network 272, which implement a type of path selector or switch. Counter 271 is driven by PClk signal 80 and counts from 0 to M−1. The value of counter 271 is passed along path 81 to network 272, which uses this value to select or enable the paths through which 3 bits of RGB color information are sent to parallel storage register 72. In this example, a count that is equal to zero cause network 72 to select paths causing RGB color information to be stored in information-storage cells 1, 2 and 3 of register 72. A count that is equal to one causes network72 to select paths for cells 4, 5 and 6. Essentially any form of switch, selector or demultiplexor for each color of information may be used.

2. Memory Access Control

Figure 12:
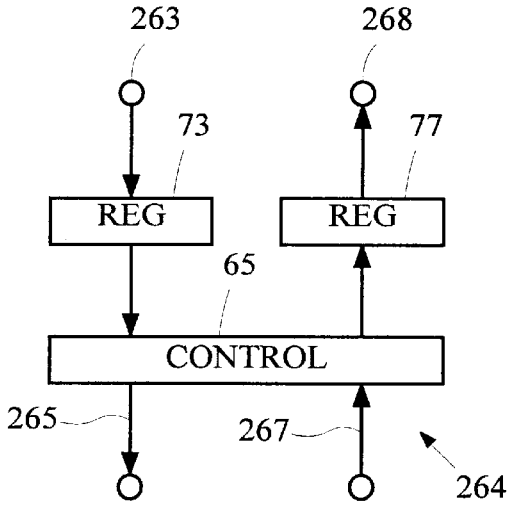
FIG. 12 is a schematic block diagram of a second portion of a half-frame buffer that incorporates multiple parallel storage registers and a memory-access controller.

One implementation of MHfb 264 is shown in FIG. 12. In this implementation, MHfb 264 receives from path 263 the 3M bits of information stored in parallel storage register 72 and stores this information in parallel storage register 73. The 3M bits of RGB information is received in the same PClk cycle when the Mth bit of information for each color component is received from paths 261-1, 261-2 and 261-3. Different implementations may store the Mth bit of information for each color in register 72 and/or may pass them directly to register 73. Although not required, the RGB information stored in register 73 is arranged in the same manner as it is arranged in register 72.

The information that is received and stored in parallel storage register 73 is subsequently stored in memory 266. Memory-access control 65 controls a sequence of operations that store this information in memory 266 after other information has been fetched from memory 266. Information is fetched from and stored to memory 266 in synchronization with a digital clock signal MClk. The two sets of parallel storage registers 72 and 73 in PHfb 262 and MHfb 264, respectively, allow PHfb 262 to receive and convert serial information while MHfb 264 waits to store the parallel information in memory 266.

In a preferred implementation, M bits of RGB color information for each color component is fetched from memory 266 and loaded into parallel storage register 77 during one cycle of MClk. This fetched information is subsequently passed along path 268 through PHfb 262 and path 269 to display interface 250. Display interface 250 in turn passes this fetched information to display device 20 to refresh one of the display 20 panels.

Some of the benefits realized by the present invention can be better appreciated by comparing an exemplary implementation of a conventional HFB with an exemplary implementation of a HFB according to the present invention. In these examples, the conventional HFB comprises shift and parallel storage registers that have the capacity to store N=64 bits, and the improved HFB according to the present invention comprises parallel storage registers that have the capacity to store 3M=63 bits.

In the conventional HFB, a complete set of 3N=3×64=192 bits of RGB color information can be obtained from memory 266 by three fetches. In the improved HFB, 3M=63 bits of RGB color information can be obtained by one fetch, which means 3×63=189 bits of RGB color information can be recorded by three memory store operations. The throughput of the information fetched or stored by the two HFB implementations is nearly the same; however, unlike the conventional HFB, the improved HFB is able to fetch or store a complete sets of RGB information in only one memory access. This feature allows the information obtained from memory 266 by any one fetch to be passed immediately to interface 250 without concern for any subsequent interruptions due to demands for services by high-priority events. As a result, it is possible to reduce the amount of information for any one color that should be fetched at one time, which allows the total register storage capacity and resulting implementation costs to be reduced. The amount of this reduction is discussed below.

3. Implementation Costs

Figure 11:
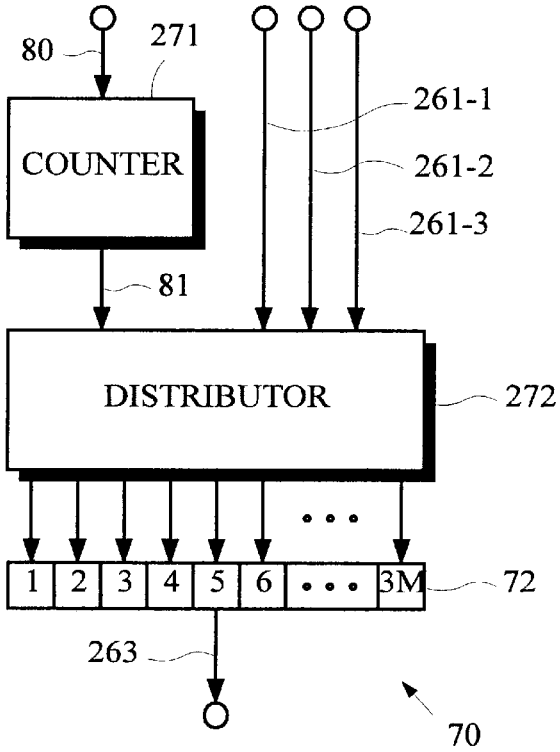
FIG. 11 is a schematic block diagram of a first portion of a half-frame buffer that incorporates a particular implementation for a signal distributor.

In the implementation shown in FIGS. 10 and 11, assuming M=21, distributor 70 may be implemented using logic circuits and as few as five flip-flops for counter 271. Parallel storage registers 72, 73 and 77 may each be implemented with 3M=63 flip-flops, as shown in the following table:

TABLE II

| Register | Cost | M = 21 |
|---|---|---|
| Distributor (70) | $\log_2$ M | 5 |
| Parallel storage register (72) | 3 M | 63 |
| Input parallel register (73) | 3 M | 63 |
| Output parallel register (77) | 3 M | 63 |
| Total flip-flop count | ~9 M | 194 |

The examples shown in Tables I and II clearly show that preferred HFB implementations according to the present invention are able to reduce the total flip-flop count by approximately 75 per cent. This reduction in count also achieves a similar reduction in power requirements.

As mentioned above, shift registers may be used to implement distributor 70. In an implementation such as this, the total number of flip-flops is 18M, which is equal to 378 flip-flops for M=21. Alternatively, a distributor such as that shown in FIG. 11 may be used to replace the shift registers in a conventional HFB. In this implementation, the total flip-flop count is about 9N, which is 576 flip-flops for N=64. Although neither implementation is preferred, both are able to reduce implementation and operation costs below that required for a HFB of conventional design.

What is claimed is:

1. A buffer in a display controller that provides output signals representing pixels in a color image for presentation on a display device, the buffer comprising:

a first storage register to receive first parallel signals conveying bits representing all of the colors in a plurality of colors;

a second storage register coupled to the first storage register to receive second parallel signals representing a first set of bits representing all of the colors in the plurality of colors;

an information-storage memory;

a memory-access controller coupled to the information-storage memory to retrieve second information from a location in the information-storage memory that represents a second set of bits representing all of the colors in the plurality of colors and to provide fourth parallel signals conveying the second information, and coupled to the second storage register to receive third parallel signals conveying first information that represents the first set of bits and to write the first information to the location in the information-storage memory; and an output-interface circuit coupled to the memory-access controller to receive signals conveying the second information and, in response, to generate output signals representing the second information as a portion of the image for presentation by the display device.

2. A buffer according to claim 1 wherein a third storage register is interposed between the memory-access controller and the output-interface circuit to receive the fourth parallel signals conveying the second information and to send fifth parallel signals conveying the second information to the output-interface circuit.

3. A buffer according to claim 1 wherein the first set of bits represent red, green and blue colors for each pixel in an image for presentation on a video display device.

4. A buffer according to claim 3 wherein the video display device comprises one or more liquid crystal display panels.

5. A buffer according to claim 1 wherein the first and second storage registers each comprise a plurality of information-storage cells, each information-storage cell storing binary information corresponding to a respective bit, wherein adjacent information-storage cells within the first and/or second storage registers store interleaved binary information for all of the plurality of colors.

6. A buffer according to claim 5 wherein adjacent information-storage cells within the first and/or second storage registers store binary information that is interleaved bit-by-bit for all of the plurality of colors.

7. A buffer according to claim 1 wherein the first and second storage registers each comprise a plurality of information-storage cells, each cell implemented by a bistable flip-flop circuit.

8. A buffer according to claim 1 that comprises a distributor having a plurality of inputs to receive a plurality of digital signals, each input to receive a respective digital signal conveying a sequence of bits representing a respective color in the plurality of colors for each of the pixels, and having a plurality of outputs coupled to the first storage register to provide the first parallel signals.

9. A buffer according to claim 8 wherein the distributor comprises:

a switching network having the plurality of inputs to receive the plurality of digital signals and having the plurality of outputs, and a counter coupled to the switching network to control switching of the plurality of digital signals to one or more of the plurality of outputs.

10. A buffer according to claim 1 that comprises a plurality of shift registers, a respective shift register having an input to receive a respective digital signal conveying a sequence of bits representing a respective color in the plurality of colors for each of the pixels and having a plurality of outputs coupled to a portion of the first storage register.

11. A buffer in a display controller that provides output signals representing pixels in a color image for presentation on a liquid crystal display (LCD) panel, the buffer comprising:

an LCD interface circuit having inputs coupled to video memory;

a distribution circuit having inputs coupled to outputs of the LCD interface circuit;

a first storage register having parallel inputs coupled to outputs of the distribution circuit to receive parallel signals conveying bits representing all colors in a plurality of colors;

a second storage register having parallel inputs coupled to parallel outputs of the first storage register to receive parallel signals conveying bits representing all colors in the plurality of colors;

information-storage memory; and a memory-access controller having parallel input/output ports coupled to the information-storage memory, having parallel inputs coupled to parallel outputs of the second storage register, and having outputs coupled to inputs of the LCD interface circuit, wherein the memory-access controller causes information representing all colors in the plurality of colors to be written into the information-storage memory in a single memory access and causes information representing all colors in the plurality of colors to be retrieved from the information-storage memory in a single memory access.

12. A buffer according to claim 11 that comprises a third storage register interposed between the memory-access controller and the LCD interface circuit, wherein the memory-access controller has parallel outputs coupled to parallel inputs of the third storage register, and the third storage register has-parallel outputs coupled to inputs of the LCD interface circuit.

13. A buffer according to claim 11 wherein the display controller provides output signals representing red, green and blue components of the image pixels, and wherein the distribution circuit comprises:

a first switching network to receive signals from the LCD interface circuit conveying bits representing red components;

a second switching network to receive signals from the LCD interface circuit conveying bits representing green components;

a third switching network to receive signals from the LCD interface circuit conveying bits representing blue components; and the first storage register comprises groups of adjacent information-storage cells, a respective cell in each group coupled to an output of a respective switching network to receive and store information representing bits of the red, green and blue components, respectively.

14. A buffer according to claim 11 wherein the first and second storage registers each comprise a plurality of information-storage cells, each information-storage cell storing binary information corresponding to a respective bit, wherein adjacent information-storage cells the first and/or second storage registers store interleaved binary information for all of the plurality of colors.

15. A buffer according to claim 14 wherein adjacent information-storage cells within the first and/or second storage registers store binary information that is interleaved bit-by-bit for all of the plurality of colors.

16. A buffer according to claim 11 wherein the first and second storage registers each comprise a plurality of information-storage cells, each cell implemented by a bistable flip-flop circuit.

17. A method for receiving and storing information in a buffer of a display controller that provides output signals representing pixels in a color image for presentation on a display device, the method comprising:

receiving a plurality of digital signals, each signal conveying a sequence of bits representing a respective color in a plurality of colors for each of the pixels;

distributing a first set of bits conveyed by the digital signals into information-storage cells of a first storage register such that the first storage register stores information representing all of the colors in the plurality of colors;

sending parallel signals representing the first set of bits as stored in the first storage register to information-storage cells in a second storage register;

retrieving second information from a location in information-storage memory that represents a second set of bits representing all of the colors in the plurality of colors and providing signals conveying the second information;

writing first information to the location in the information-storage memory representing the first set of bits; and sending the signals conveying the second information to an interface circuit and, in response, generating output signals representing the second information as a portion of the image for presentation by the display device.

18. A method according to claim 17 that comprises providing the signals conveying the second information as parallel signals to a third storage register, and sending from the third storage register parallel signals conveying the second information to the output-interface circuit.

19. A method according to claim 17 wherein the plurality of colors are red, green and blue, and the output signals represent pixels in a color image for presentation on a video display device.

20. A method according to claim 19 wherein the video display device comprises one or more liquid crystal display panels.

21. A method according to claim 17 wherein the first and second storage registers each comprise a plurality of information-storage cells, each information-storage cell storing binary information corresponding to a respective bit, wherein the method stores interleaved binary information for all of the plurality of colors in adjacent information-storage cells within the first and/or second storage registers.

22. A method according to claim 21 that stores binary information that is interleaved bit-by-bit for all of the plurality of colors in adjacent information-storage cells within the first and/or second storage registers.

23. A buffer in a display controller that provides output signals representing pixels in a color image for presentation on a display device, the buffer comprising:

a switching network having a plurality of inputs to receive a plurality of digital signals, each input to receive a respective digital signal conveying a sequence of bits representing a respective color in the plurality of colors for each of the pixels;

a first set of storage registers coupled to the switching network to receive first parallel signals conveying bits representing all of the colors in a plurality of colors;

a second set of storage registers coupled to the first set of storage registers to receive second parallel signals conveying a first set of bits representing all of the colors in the plurality of colors;

a third set of storage registers;

an information-storage memory;

a memory-access controller coupled to the information-storage memory to retrieve second information from a location in the information-storage memory that represents a second set of bits representing all of the colors in the plurality of colors and to provide fourth parallel signals conveying the second information to the third set of storage registers, and coupled to the second set of storage registers to receive third parallel signals conveying first information that represents the first set of bits and to write the first information to the location in the information-storage memory; and an output-interface circuit coupled to the third set of storage registers to receive fifth parallel signals conveying the second information and, in response, to generate output signals representing the second information as a portion of the image for presentation by the display device.

24. A buffer according to claim 23 wherein the switching network has a control input coupled to a counter to control switching of the plurality of digital signals to the first set of storage registers.

* * * * *